US007611367B2

(12) United States Patent
Lee

(10) Patent No.: US 7,611,367 B2
(45) Date of Patent: Nov. 3, 2009

(54) MULTIMEDIA CABLE

(75) Inventor: Dae Kun Lee, Seoul (KR)

(73) Assignee: Hyundai Motor Company, Seoul (KR)

( * ) Notice: Subject to any disclaimer, the term of this patent is extended or adjusted under 35 U.S.C. 154(b) by 0 days.

(21) Appl. No.: 12/276,647

(22) Filed: Nov. 24, 2008

(65) Prior Publication Data

US 2009/0156036 A1 Jun. 18, 2009

(30) Foreign Application Priority Data

Dec. 18, 2007 (KR) ..... 10-2007-0133106

(51) Int. Cl.
*H01R 27/00* (2006.01)

(52) U.S. Cl. ..... 439/218; 439/502; 439/623

(58) Field of Classification Search ..... 439/218, 439/217, 502, 623, 259, 669
See application file for complete search history.

(56) References Cited

U.S. PATENT DOCUMENTS 5,087,207 A * 2/1992 Byrne ..... 439/215
6,231,379 B1 * 5/2001 Shen ..... 439/505
6,749,451 B2 * 6/2004 Schmitt ..... 439/218
6,945,803 B2 * 9/2005 Potega ..... 439/218
7,316,589 B1 * 1/2008 Rogers et al. ..... 439/668

* cited by examiner

*Primary Examiner*—Hien Vu
(74) *Attorney, Agent, or Firm*—Edwards Angell Palmer & Dodge LLP; Peter F. Corless

(57) ABSTRACT

A multimedia cable includes a casing, a terminal pin, an audio signal unit, a video signal unit, and a control lever. The terminal pin is mounted to the casing so as to be rotated with respect to a rotary shaft, and is configured such that first and second four-conductor terminals are arranged on respective sides of the rotary shaft. A audio signal unit comprising three-conductor connection pins each one end of which is rotatably mounted in the casing and audio cables each of which is connected with said each one end of the three-conductor connection pins respectively. A video signal unit comprising four-conductor connection pins mounted opposite the three-conductor connection pins, each one end of which is rotatably mounted in the casing and video cables which are connected with said each one end of the four-conductor connection pins. The control lever is connected to both the three-conductor connection pins and the four-conductor connection pins to connect either the three-conductor connection pins or the four-conductor connection pins to the terminal pin.

5 Claims, 5 Drawing Sheets

MULTIMEDIA CABLE

CROSS-REFERENCE TO RELATED APPLICATIONS

This application claims under 35 U.S.C. §119(a) priority to Korean Application No. 10-2007-0133106, filed on Dec. 18, 2007, the disclosure of which is incorporated herein by reference in its entirety.

BACKGROUND

1. Technical Field

The present invention relates generally to a multimedia cable, which can be switched into a three-conductor audio cable or into a four-conductor video cable for use thereof, and, more particularly, to a multimedia cable.

2. Background Art

Some vehicles are provided with an integrated Audio/Video (A/V) system, which is implemented by integrating video playback devices with car audio devices. Accordingly, display devices are mounted to vehicles so as to make it possible to view video, as wells as to listen to audio, while the vehicles travels, and thus terrestrial or satellite TeleVision (TV) broadcasts can be viewed even when the vehicles are moving. In addition, high-fidelity sounds and high-quality video can be enjoyed when video CD players are mounted in the vehicles.

In such a vehicle A/V system, a three-conductor audio cable is necessary to listen to audio, and a four-conductor video cable is necessary to view video.

The three-conductor audio cable 200 and the four-conductor video cable 300 are individually manufactured, as shown in FIG. 1. The three-conductor audio cable 200 includes three conductors, that is, an AUX-L conductor 210, an AUX-R conductor 212 and an AUX-GND conductor 214. These three conductors are formed in a terminal pin 220 so that electrical connection can be made. Meanwhile, the four-conductor video cable 300 include four conductors, that is, an AUX-L conductor 312, an AUX-R conductor 310, a VIDEO-IN conductor 316 and an AUX-GND conductor 314. These four conductors are formed in a terminal pin 320.

Accordingly, conventionally, there is inconvenience in that a user must individually purchase the three-conductor audio cable 200 and the four-conductor video cable 300, and in that the user must search for the cables every time and must connect the audio and video devices of an AV system using the cables after finding them.

The above information disclosed in this the Background section is only for enhancement of understanding of the background of the invention and therefore it may contain information that does not form the prior art that is already known in this country to a person of ordinary skill in the art.

SUMMARY OF DISCLOSURE

Accordingly, the present invention has been made keeping in mind the above problems occurring in the prior art, and the present invention is to provide a multimedia cable, which enables a three-conductor audio cable for audio devices and a four-conductor video cable for video devices to be used by means of a single cable, thus not only increasing users convenience but also reducing the retail price of cables.

According to one aspect of the present invention, a multimedia cable includes: a casing; a terminal pin mounted to the casing so as to be rotated with respect to a rotary shaft, and configured such that first and second four-conductor terminals are arranged on respective sides of the rotary shaft; an audio signal unit configured such that three-conductor connection pins are mounted in the casing so as to be rotated, the three-conductor connection pins being connected to an audio cable; a video signal unit configured such that four-conductor connection pins are mounted opposite the three-conductor connection pins so as to be rotated, the four-conductor connection pins being connected to a video cable; and a control lever connected to both the three-conductor connection pins and the four-conductor connection pins to connect either the three-conductor connection pins or the four-conductor connection pins to the terminal pin.

The terminal pin may be configured such that a convex head portion is formed in one end thereof and such that a concave head portion is formed in the remaining end thereof. The control lever may be raised and lowered by coming into contact with the convex head portion or the concave head portion, thus selectively connecting either the three-conductor connection pins or the four-conductor connection pins to the terminal pin.

The control lever may be supported upwards by a spring. The spring may store elastic potential while the control lever is lowered when coming into contact with the convex head portion of the terminal pin. The control lever may be raised by the elasticity of the spring when coming into contact with the concave head portion of the terminal pin.

The three-conductor connection pins of the audio signal unit may be electrically connected with the respective AUX-L, AUX-R and AUX-GND conductors of the first four-conductor terminal of the terminal pin.

The four-conductor connection pins of the video signal unit may be electrically connected with the respective AUX-L, AUX-R, VIDEO-IN and AUX-GND conductors of the first four-conductor terminal of the terminal pin.

The casing may include a concave depression therein, corresponding to the direction of rotation of the terminal pin, and the terminal pin may be rotated so as to pass through the concave depression.

It is understood that the term "vehicle" or "vehicular" or other similar term as used herein is inclusive of motor vehicles in general such as passenger automobiles including sports utility vehicles (SUV), buses, trucks, various commercial vehicles, watercraft including a variety of boats and ships, aircraft, and the like, and includes hybrid vehicles, electric vehicles, plug-in hybrid electric vehicles, hydrogen-powered vehicles and other alternative fuel vehicles (e.g. fuels derived from resources other than petroleum). As referred to herein, a hybrid vehicle is a vehicle that has two or more sources of power, for example both gasoline-powered and electric-powered vehicles.

The above and other features of the invention are discussed infra.

BRIEF DESCRIPTION OF THE DRAWINGS

The above and other objects, features and advantages of the present invention will be more clearly understood from the following detailed description taken in conjunction with the accompanying drawings, in which:

FIGS. 4A and 4B are views illustrating the operation of a multimedia cable according to an embodiment of the present invention, in which:

FIG. 4A is a view showing the case where the multimedia cable is used as a three-conductor audio cable, and FIG. 4B is a view showing the case where the multimedia cable is used as a four-conductor video cable.

DETAILED DESCRIPTION

Preferred embodiments of the present invention will be described with reference to the accompanying drawings below.

Figure 1A:
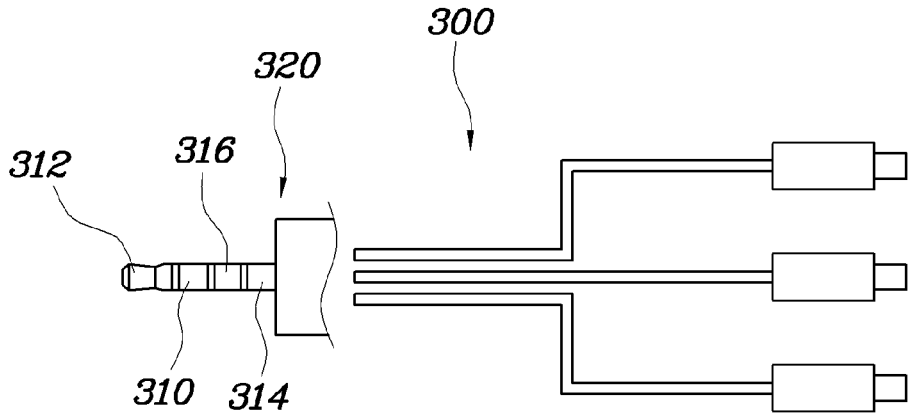
FIGS. 1A and 1B are views showing the respective constructions of a conventional three-conductor audio cable and a conventional four-conductor video cable in the related art.
Figure 1B:
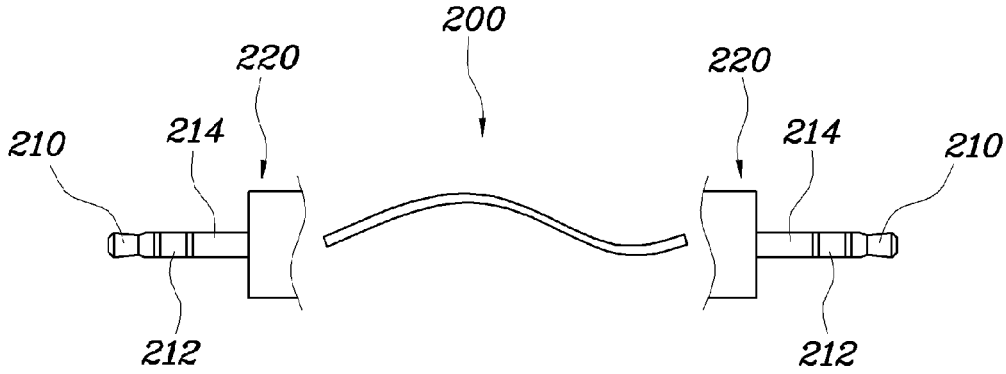
Figure 2:
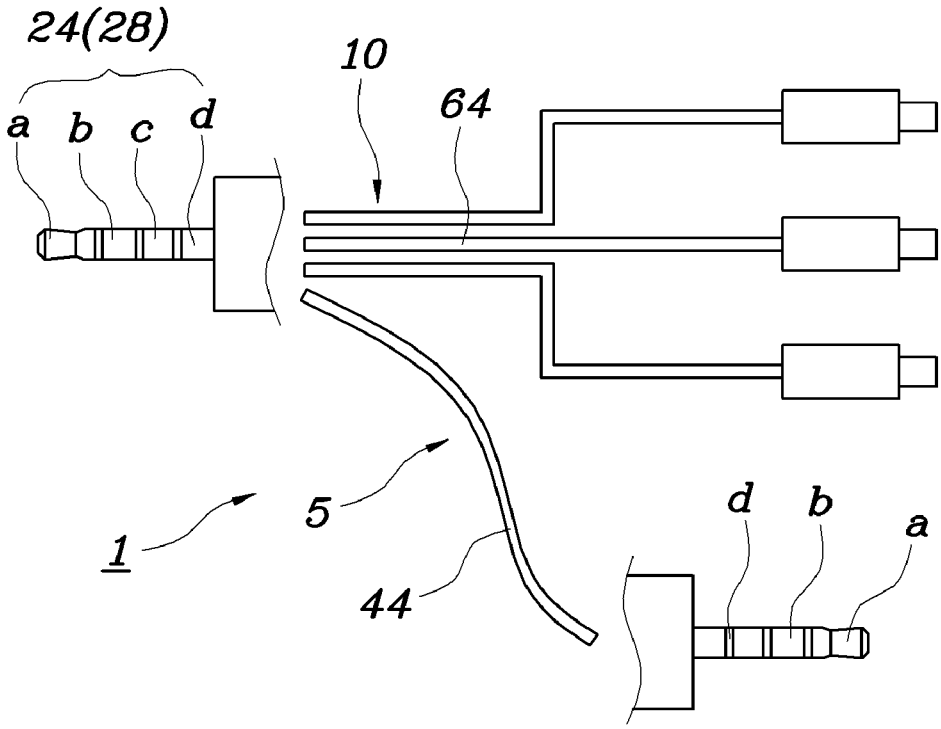
FIG. 2 is a view showing the construction of a multimedia cable according to an embodiment of the present invention, which can be switched into a three-conductor audio cable or a four-conductor video cable.

As shown in FIG. 2, a multimedia cable 1 according to an embodiment of the present invention, which can be switched into a three-conductor audio cable or a four-conductor video cable, is implemented by integrating a three-conductor audio cable 5 for audio devices and a four-conductor video cable 10 for video devices so that they can be selectively used by a user.

Figure 3:
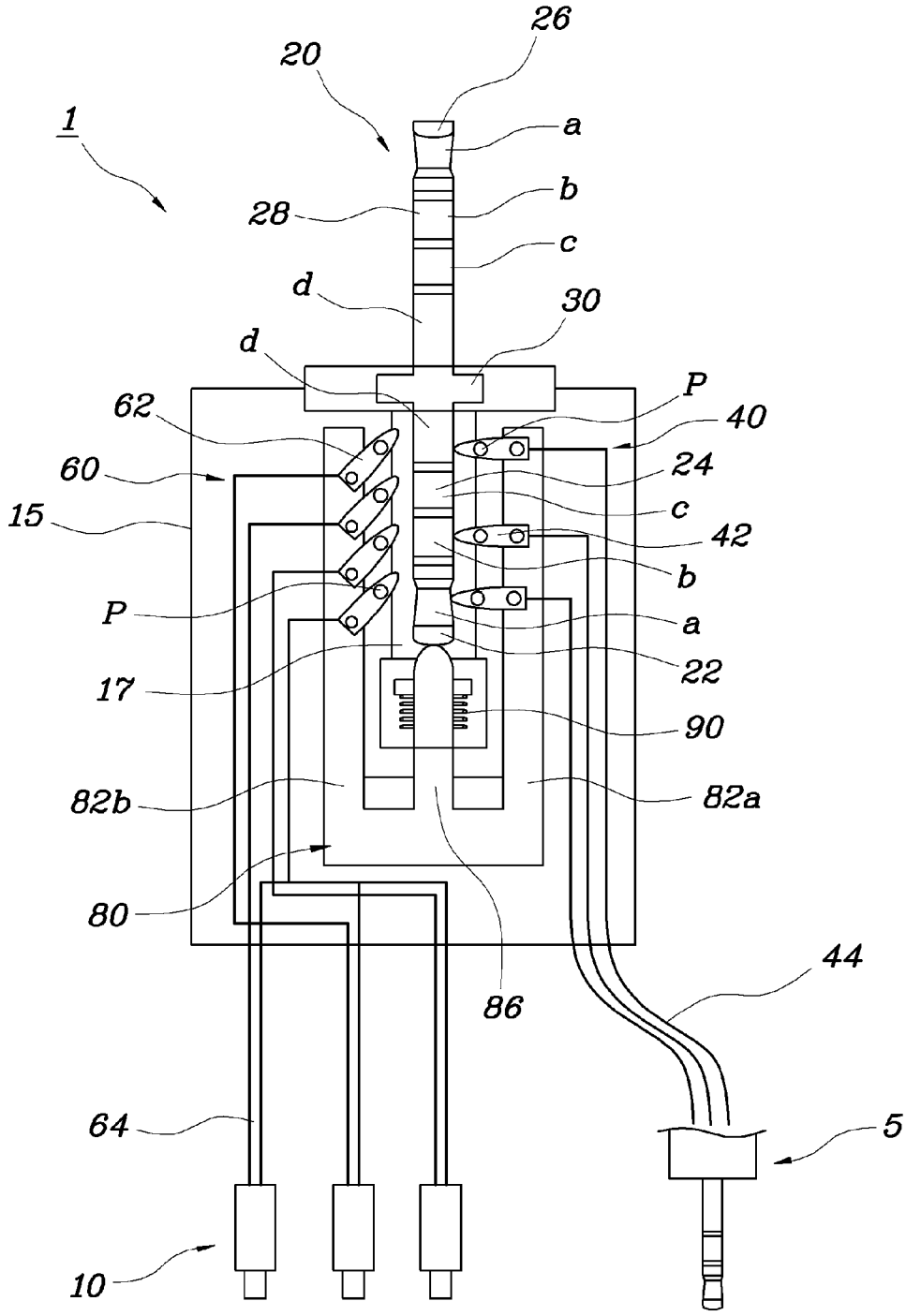
FIG. 3 is a sectional view showing a multimedia cable according to an embodiment of the present invention.

The multimedia cable 1 includes a casing 15, in which a hollow space having a predetermined size is formed. The casing 15 is made of an insulating material. It is configured such that a long concave depression 17 is formed therein and an audio signal unit 40, a video signal unit 60 and a control lever 80 are mounted therein, as shown in FIG. 3.

A terminal pin 20 is rotatably mounted to the casing 15. The terminal pin 20 is configured such that a plurality of four-conductor terminals 24 and 28 are arranged along the same axis, a convex head portion 22 is formed in one end thereof, and a concave head portion 26 is formed in the other end thereof.

In order to enable the mounting of the terminal pin 20, the casing 15 is configured such that a hinge shaft 30 of the terminal pin 20 is rotatably mounted in the central portion of the upper portion of thereof, and the long concave depression 17 is formed in a region in which the four-conductor terminals 24 and 28 of the terminal pin 20 are located.

Figure 4A:
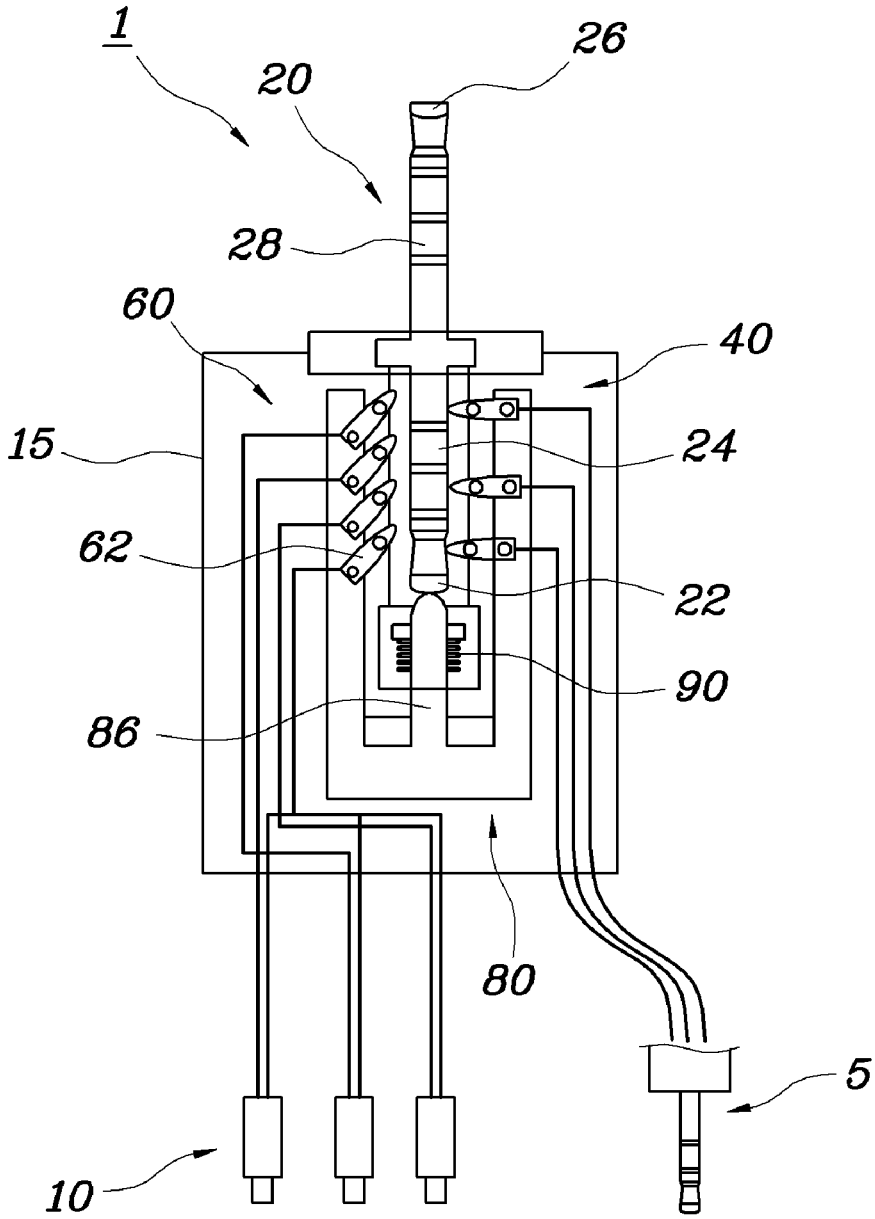
Figure 4B:
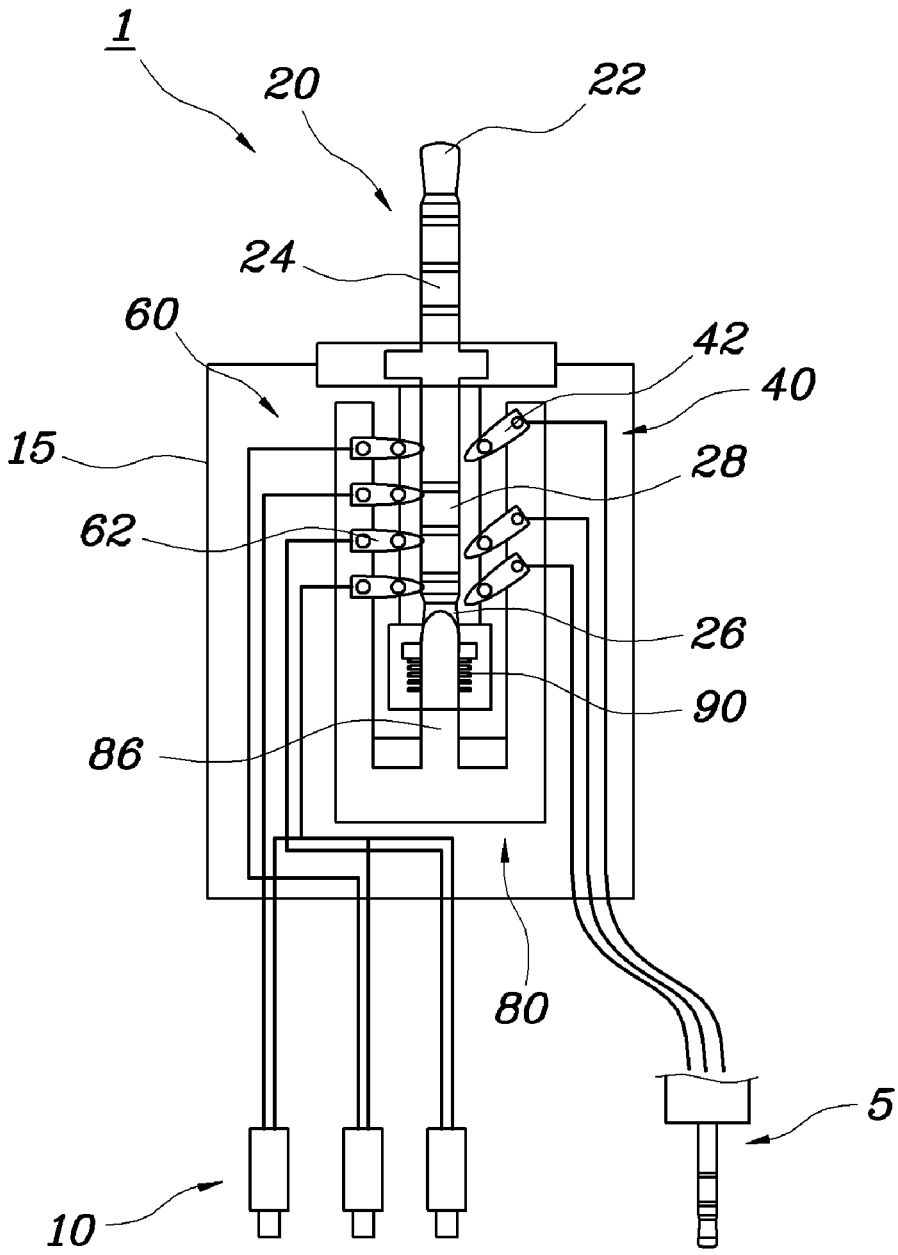

Referring to FIGS. 4A and 4B, the plurality of four-conductor terminals 24 and 28 are rotatably mounted at the upper end of the long concave depression 17 of the casing 15. As shown in FIG. 4A, the four-conductor terminal 24 on the side of the convex head portion 22 may be located in the long concave depression 17, and the four-conductor terminal 28 on the side of the concave head portion 26 may be located outside the long concave depression 17.

When the terminal pin 20 is rotated 180 degree around the hinge shaft 30, the four-conductor terminal 28 on the side of the concave head portion 26 may be located in the long concave depression 17, and the four-conductor terminal 24 on the side of the convex head portion 22 may be located outside the long concave depression 17, as shown in FIG. 4B.

In the above-described terminal pin 20, respective conductors of the four-conductor terminal 24 on the side of the convex head portion 22 and the four-conductor terminal 28 on the side of the concave head portion 26, which are located in or outside the casing 15, are electrically connected. Accordingly, when one of the four-conductor terminal 24 on the side of the convex head portion 22 and the four-conductor terminal 28 on the side of the concave head portion 26 comes into contact with either the three-conductor connection pins 42 of an audio signal unit 40 or the four-conductor connection pins 62 of an video signal unit 60, which will be described later, the effect of electrically connecting these connection pins to the other four-conductor terminal is achieved.

Returning to FIG. 3, an audio signal unit 40 comprising three-conductor connection pins 42 each one end of which is rotatably mounted in the casing 15 and audio cables 5 each of which is connected with said each one end of the three-conductor connection pins 42 respectively.

The three-conductor connection pins 42 are electrically connected to the respective AUX-L, AUX-R and AUX-GND conductors a, b and d of the terminal pin 20, which will be described later.

A video signal unit 60 comprising four-conductor connection pins 62 mounted opposite the three-conductor connection pins 42, each one end of which is rotatably mounted in the casing 15 and video cables 10 which are connected with said each one end of the four-conductor connection pins 62.

In the above-described video signal unit 60, the four-conductor connection pins 62 are electrically connected to the respective AUX-L, AUX-R, VIDEO-IN and AUX-GND conductors a, b, c and d of the terminal pin 20.

The control lever 80 is provided in the casing 15. The above-described control lever 80 has a ∃-shaped structure in which one portion 82*a* thereof is connected to the three-conductor connection pins 42 so as to be rotated, and another portion 82*b* thereof is connected to the four-conductor connection pins 62 so as to be rotated.

The control lever 80 is mounted to be raised or lowered by bringing the central control bar 86 thereof into contact with the convex head portion 22 or concave head portion 26 of the terminal pin 20, and causes the three-conductor connection pins 42 or the four-conductor connection pins 62 to be rotated around the respective rotary shafts P in the casing 15, so that these connection pins can be electrically connected to the four-conductor terminals 24 and 28 of the terminal pin 20.

The control lever 80 is supported by a spring 90 in the casing 15. The spring 90 is fastened in the casing 15 to elastically support the control bar 86 upwards, stores elastic potential when the control bar 86 comes into contact with the convex head portion 22 of the terminal pin 20, and enables the control bar 86 to be raised by pushing the control bar 86 into the concave head portion 26 using the elastic potential when the control bar 86 comes into contact with the concave head portion 26 of the terminal pin 20.

Accordingly, when the control bar 86 is lowered by coming into contact with the convex head portion 22 of the terminal pin 20, the control lever 80 causes the three-conductor connection pins 42 to protrude from the slit 19 of the casing 15 to the long concave depression 17 by rotating the three-conductor connection pins 42 of the audio signal unit 40, and thus the three-conductor connection pins 42 are electrically connected to the four-conductor terminal 24 of the terminal pin 20.

Meanwhile, when the control bar 86 is raised by coming into contact with the concave head portion 26 of the terminal pin 20, the control lever 80 causes the four-conductor connection pins 62 to come into contact with the terminal pin 20 by rotating the four-conductor connection pins 62 of the video signal unit 60, and thus the four-conductor connection pins 62 are electrically connected to the four-conductor terminal 28 of the terminal pin 20. At the same time, the control lever 80 causes the three-conductor connection pins 42 to be separated from the terminal pin 20 by rotating the three-conductor connection pins 42 of the audio signal unit 40, and thus the three-conductor connection pins 42 are electrically disconnected from the four-conductor terminal 28 of the terminal pin 20.

In the above-described multimedia cable 1, which can be switched into a three-conductor audio cable or a four-conductor video cable, the three-conductor audio cable 5 for audio devices and the four-conductor video cable 10 for video devices are integrated into a single body, thus enabling a user to use it selectively, as shown in FIGS. 4A and 4B.

As shown in FIG. 4A, when it is desired to use the above-described multimedia cable 1 as a three-conductor audio cable 5 for audio devices, the convex head portion 22 of the terminal pin 20 and the four-conductor terminal 24 are located in the long concave depression 17 of the casing 15, and the concave head portion 26 and the four-conductor terminal 28 are disposed to protrude toward the front of the casing 15.

In this case, when the control bar 86 comes into contact with the convex head portion 22 of the terminal pin 20, and thus stores the elastic potential of the spring 90, the control lever 80 is moved downwards. Accordingly, the control lever 80 causes the three-conductor connection pins 42 to come into contact with the terminal pin 20 by rotating the three-conductor connection pins 42 of the audio signal unit 40 while being moved downwards, and thus the three-conductor connection pins 42 are electrically connected to the four-conductor terminal 24 on the side of the convex head portion 22 of the terminal pin 20. At the same time, the control lever 80 causes the four-conductor connection pins 62 to be separated from the terminal pin 20 by rotating the four-conductor connection pins 62 of the video signal unit 60, and thus the four-conductor connection pins 62 are electrically disconnected from the four-conductor terminal 24 of the terminal pin 20.

Accordingly, the three-conductor connection pins 42 of the audio signal unit 40 are electrically connected with the respective AUX-L, AUX-R and AUX-GND conductors a, b d of the terminal pin 20 on the side of the convex head portion 22 of the terminal pin 20.

Bringing the three-conductor connection pins 42 of the audio signal unit 40 into contact with the respective AUX-L, AUX-R and AUX-GND conductors a, b d of the four-conductor terminal 24, which is formed on the side of the convex head portion 22 of the terminal pin 20, as described above, means that an electrical connection with the corresponding four-conductor terminal 28, which is formed on the side of the concave head portion 26, is achieved, and thus the effect of bringing the four-conductor terminal 28 of the concave head portion 26 into contact with the AUX-L conductor a, the AUX-R conductor b and the AUX-GND conductor d is achieved.

Accordingly, the user can use the multimedia cable 1 as a three-conductor video cable 5 for audio devices by connecting it to a vehicle A/V system.

On the other hand, in this state, when it is desired to use the multimedia cable 1 as a four-conductor video cable 10 for video devices, the concave head portion 26 of the terminal pin 20 and the four-conductor terminal 28 are located in the long concave depression 17 of the casing 15, and the terminal pin 20 is rotated around the hinge shaft 30 so that the convex head portion 22 and the four-conductor terminal 24 protrude toward the front of the casing 15.

In this case, when the control bar 86 comes into contact with the concave head portion 26 of the terminal pin 20, the control lever 80 is moved upwards into the concave head portion 26 by the elasticity of the spring 90. Accordingly, the control lever 80 causes the four-conductor connection pins 62 to come into contact with the terminal pin 20 by rotating the four-conductor connection pins 62 of the video signal unit 60 to be horizontally maintained while being moved upwards, and thus the terminal pin 20 and the four-conductor terminal 28 are electrically connected to each other. At the same time, the control lever 80 causes the three-conductor connection pins 42 to be separated from the terminal pin 20 by rotating the three-conductor connection pins 42 of the audio signal unit 40, and thus the terminal pin 20 and the four-conductor terminal 28 of the concave head portion 26 are electrically separated from each other.

In this case, the four-conductor connection pins 62 of the video signal unit 60 are electrically connected to the respective AUX-L, AUX-R, VIDEO-IN, and AUX-GND conductors a, b, c and d, which are provided on the side of the concave head portion 26 of the terminal pin 20.

Bringing the four-conductor connection pins 62 of the video signal unit 60 into contact with the respective AUX-L, AUX-R, VIDEO-IN, and AUX-GND conductors a, b, c and d, which are provided on the side of the concave head portion 26 of the terminal pin 20, as described above, means that an the electrical connection with the corresponding four-conductor terminal 24, which is formed on the side of the convex head portion 22, is achieved, and thus the effect of bringing the four-conductor terminal 24 of the convex head portion 22 into contact with respective AUX-L, AUX-R, VIDEO-IN, and AUX-GND conductors a, b, c and d of the terminal pin 20 is achieved.

Accordingly, the user can use the multimedia cable 1 as a four-conductor video cable 10 for video devices by connecting it to a vehicle A/V system.

As described above, the multimedia cable 1 can be used as a three-conductor audio cable 5 for audio devices and a four-conductor video cable 10 for video devices, thus improving users convenience and reducing the price.

Although the preferred embodiments of the present invention have been disclosed for illustrative purposes, those skilled in the art will appreciate that various modifications, additions and substitutions are possible, without departing from the scope and spirit of the invention as disclosed in the accompanying claims.

What is claimed is:

1. A multimedia cable, comprising:

a casing;

a terminal pin mounted to the casing so as to be rotated with respect to a rotary shaft, and configured such that first and second four-conductor terminals are arranged on respective sides of the rotary shaft;

an audio signal unit comprising three-conductor connection pins each one end of which is rotatably mounted in the casing and audio cables each of which is connected with said each one end of the three-conductor connection pins respectively;

a video signal unit comprising four-conductor connection pins mounted opposite the three-conductor connection pins, each one end of which is rotatably mounted in the casing and video cables which are connected with said each one end of the four-conductor connection pins; and a control lever connected to both the three-conductor connection pins and the four-conductor connection pins to connect either the three-conductor connection pins or the four-conductor connection pins to the terminal pin;

wherein the casing comprises a concave depression therein, corresponding to a direction of rotation of the terminal pin; and the terminal pin is rotated so as to pass through the concave depression.

2. The multimedia cable as set forth in claim 1, wherein:

the terminal pin is configured such that a convex head portion is formed in one end thereof and a concave head portion is formed in the other end thereof; and the control lever is configured to be able to be raised and lowered by coming into contact with the convex head portion or the concave head portion, thus selectively connecting either the three-conductor connection pins or the four-conductor connection pins to the terminal pin.

3. The multimedia cable as set forth in claim 2, wherein the control lever is supported upwards by a spring, the spring stores elastic potential while the control lever is lowered in case where the control lever comes into contact with the convex head portion of the terminal pin, and the elastic potential stored in the spring allows the control lever to be raised in case where the control lever comes into contact with the concave head portion of the terminal pin.

4. The multimedia cable as set forth in claim 3, wherein the three-conductor connection pins of the audio signal unit are electrically connected with respective AUX-L, AUX-R and AUX-GND conductors of the first four-conductor terminal of the terminal pin.

5. The multimedia cable as set forth in claim 3, wherein the four-conductor connection pins of the video signal unit are electrically connected with respective AUX-L, AUX-R, VIDEO-IN and AUX-GND conductors of the first four-conductor terminal of the terminal pin.

* * * * *